United States Patent [19]

Davidson

[11] 4,262,508

[45] Apr. 21, 1981

[54] THERMAL SHIELD WITH LOCK MECHANISM

[76] Inventor: Charlton R. Davidson, 2034 Caprock Dr., Richardson, Tex. 75080

[21] Appl. No.: 884,841

[22] Filed: Mar. 9, 1978

[51] Int. Cl.[2] ..... E05B 17/14

[52] U.S. Cl. ..... 70/455; 16/116 R

[58] Field of Search ..... 70/54, 55, 252, 455; 16/116 R, 116 A, 117, 118, DIG. 12, DIG. 18; 74/551.8, 558.5

[56] References Cited

U.S. PATENT DOCUMENTS

| | | | |
|---|---|---|---|
| 2,585,331 | 2/1952 | King | 70/455 |
| 3,638,462 | 2/1972 | White | 70/252 |

FOREIGN PATENT DOCUMENTS

| | | | |
|---|---|---|---|
| 136991 | 4/1950 | Australia | 16/117 |

*Primary Examiner*—Robert L. Wolfe

*Attorney, Agent, or Firm*—Hubbard, Thurman, Turner, Tucker & Glaser

[57] ABSTRACT

The metal surfaces of a lock mechanism are covered with a shield of a relatively low thermal conductivity material to insulate the fingers of the user from direct contact with metal to prevent possible burning or discomfort while operating the lock mechanism. In a preferred embodiment for use with automotive ignition switches of the type having raised metal wings for rotating a lock cylinder, the thermal shield comprises rubber or plastic pockets or caps which are secured in place over the metal wings to enable rotation of the lock cylinder with the fingers contacting only the surfaces of the pockets or caps.

12 Claims, 6 Drawing Figures

THERMAL SHIELD WITH LOCK MECHANISM

The present invention pertains to lock mechanisms, especially ignition switch mechanisms for motor vehicles.

In summer months in warm climates it is well known that bright sunlight can make the metal surfaces of an automotive ignition switch extremely hot to the touch.

Accordingly, it is an object of this invention to provide a means for protecting the fingers of the user from discomforting contact with such metal surfaces without interfering with the operation of the lock mechanism.

It is another object of the invention to provide a thermal shield adaptable for mounting on any of various existing types of automotive ignition switch.

These and other objects and advantages of the invention will be readily understood upon consideration of the following illustrative embodiments, when read in conjunction with the accompanying drawings, wherein.

Figure 1:
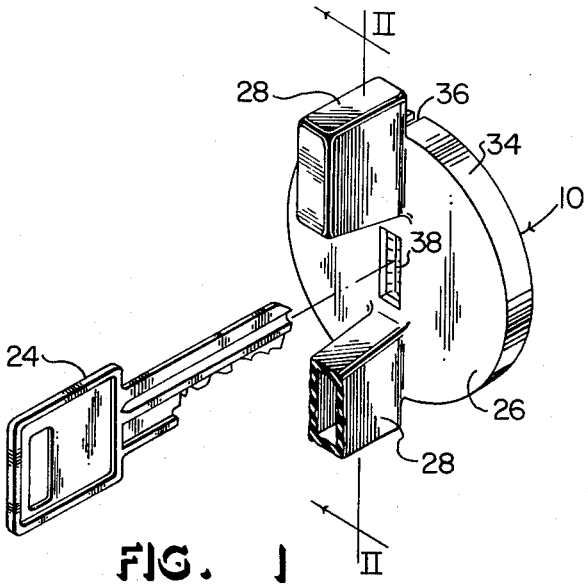
FIG. 1 is a perspective view of a thermal shield in accordance with a first embodiment of the invention shown in juxtaposition with a typical automative ignition key.
Figure 2:
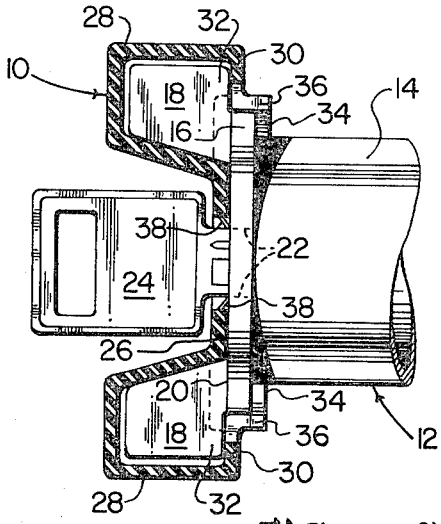
FIG. 2 is a side sectional view of the shield of FIG. 1 taken along line II—II and shown in operative relationship with a portion of an automotive ignition switch and key.
Figure 3:
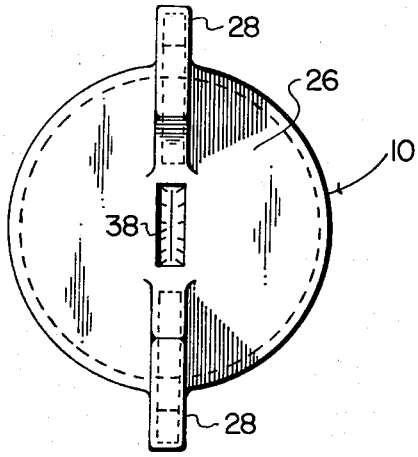
FIG. 3 is a front elevation view of the thermal shield of FIG. 1.

Referring now to the drawings, a first embodiment of the inventive thermal shield is illustrated in FIGS. 1–3 and designated generally by reference numeral 10. The shield 10 comprises a relatively low thermal conductivity material, which is preferably a moldable resilient or elastomeric material such as polyethylene, polypropylene, polyisoprene, polybutadiene, butadiene-styrene copolymer and the like. The shield 10 conforms to the outer surfaces of a metal lock mechanism 12, seen in FIG. 2, which in this example is a conventional automotive ignition switch mechanism. The mechanism 12 includes a lock cylinder 14 which terminates in a coaxially aligned disc-shaped face plate 16 with raised wings 18. Each wing 18 extends generally orthogonally outward from an outer surface 20 of the face plate 16. An opening or keyway 22 in the face plate 16 permits insertion of a key 24 into the lock cylinder 14 for actuation of the lock mechanism 12 in the conventional manner.

The shield 10 comprises a generally disc-shaped or cup-shaped base 26, which conforms to the shape of the face plate 16 and is slidable over the wings 18 so as to cover the outer metal surface 20. Projecting out from the base 26 are pockets 28 for covering the metal wings 18.

In accordance with an important feature of the embodiment of FIGS. 1–3, the walls of the pockets 28 are equipped with lips 30, seen clearly in FIG. 2, which elastically snap into position over corners 32 of the wings 18 as depicted. Optionally, the base 26 may include cylindrical walls 34, which fit snugly around the periphery of the face plate 16 as shown. The portions of the wall 34 adjacent to each pocket 28 are provided with slots or channels 36, one of which is seen clearly in FIG. 1. The slots 36 facilitate passing the wings 18 through the base 26 into the pockets 28 without undue stretching of the shield 10.

Another important feature of the shield 10 is the protection of the inner workings of the lock mechanism 12 from contamination by dust or the like. The base 26 is provided with a flexible slit membrane 38 in alignment with the keyway 22 for permitting insertion of the key 24 through the shield 10 into the lock mechanism 12. The membrane 38 elastically closes when the key 24 is removed as seen clearly in FIG. 3, thereby providing an effective dust shield over the keyway 22.

Figure 4:
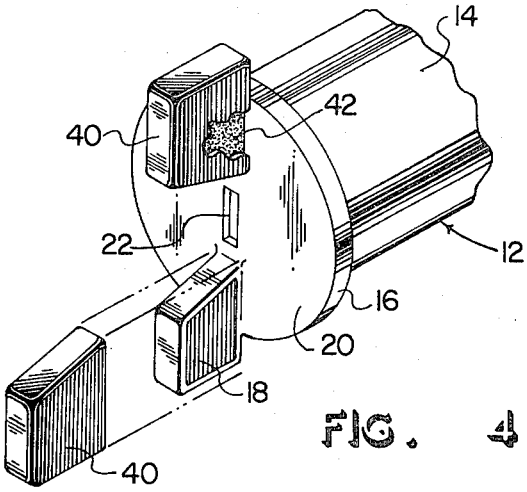
FIG. 4 is a perspective view of an alternate embodiment of a thermal shield shown in operative relationship with an automotive ignition switch.

Now referring to FIG. 4, an alternate embodiment of a thermal shield in accordance with the present invention will be described. A lock mechanism 12 similar to that described in FIG. 2 is shown with like numerals designating like parts. In this embodiment, only the metal surfaces of the raised wings 18 are shielded from contact with the fingers of the user. Thermally insulating caps 40 are placed over each wing 18 and secured thereto into a suitable manner such as by an adhesive 42. When a key is inserted into the keyway 22, the cylinder 14 can be rotated by touching only the surfaces of the caps 40, thus protecting the user's fingers from discomforting contact with hot metal. Although more economical than the embodiment of FIGS. 1–3, the caps 40 are somewhat less effective in that they do not protect against inadvertent contact with the adjacent surface 20 of the face plate 16.

Figure 5:
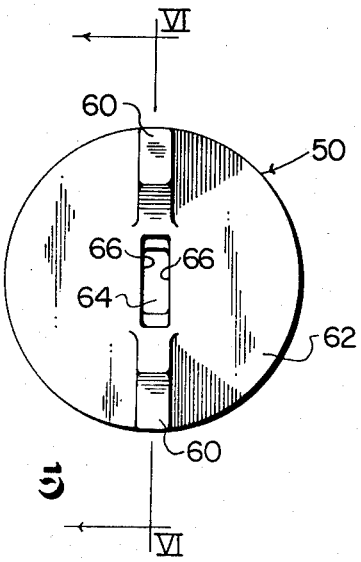
FIG. 5 is a front elevation view of another alternate embodiment of the inventive thermal shield.
Figure 6:
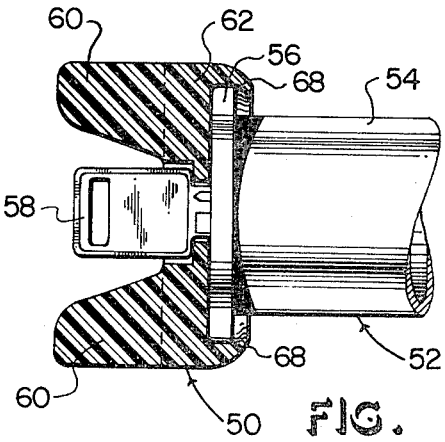
FIG. 6 is a side sectional view of the shield of FIG. 5 taken along line VI—VI and shown in operative relationship with a lock mechanism and key.

Now referring to FIGS. 5 and 6, another alternate embodiment of the inventive thermal shield is illustrated and designated generally by reference numeral 50. The shield 50 is intended for use with a lock mechanism 52 of a somewhat different construction than the previously described lock mechanism 12. The lock mechanism 52 comprises a cylinder 54 and a disc-shaped face plate 56. Unlike the previously described lock mechanism 12, the lock mechanism 52 has no raised wings to facilitate turning of the lock cylinder 54. Conventional operation of the lock mechanism 52 is achieved by applying a rotating force to a properly inserted key 58.

It will be appreciated that in hot weather environments, heat is rapidly transferred from the cylinder 54 to the key 58 giving discomfort to the user when the key 58 is touched. Accordingly, the thermal shield 50 is equipped with wings or handles 60 to permit rotation of the key 58 without making direct contact to the key 58 with one's fingers. The handles 60 extend outwardly at right angles from a circular base 62, which covers the outer surfaces of the metal face plate 56. The base 62 has a centrally located slot 64 through which the key 58 may be inserted into the cylinder 54. Within the slot 64 are longitudinal wall portions 66 of the base 62 which interact with the edges of the key 58 so that a rotational force applied to the handles 60 will be transferred to the key 58 to activate the cylinder 54.

The key 58 can be inserted and withdrawn from the lock mechanism 52 without removing the shield 50. Preferably, the shield 50 is provided with protrusions 68 which extend from the periphery of the base 62 to clip over the inner edges of the face plate 56 in the manner depicted in FIG. 6. Accordingly, the shield 50 preferably comprises a somewhat resilient plastic material or hard rubber such that the protrusions 68 will elastically snap in place as the shield 50 is installed over the face plate 56. Thus, the protrusions 68 facilitate holding the shield 50 in place as shown by the frictional engagement or clipping effect of the protrusions 68 around the face plate 56.

It will be seen that the various embodiments of the inventive thermal shield herein described enable actuation of a lock mechanism without necessity of contacting the metal surfaces thereof. In addition to the abovementioned utility of the invention in very hot environments, it will be appreciated that the invention has advantageous applicability in very cold environments where direct contact with metal by the skin can be very discomforting or even injurious to the user.

The present invention contemplates that the various embodiments 10, 40 and 50 be permanently or semi-permanently installed. The means for securing the thermal shields in place can be varied among the embodiments in any desired manner. Thus, for example, the shield 10 of FIG. 2 can be modified in an acceptable manner by providing the cylindrical walls 34 with means for clipping over the face plate 16 in the manner of the protrusions 68 shown in the embodiment of FIG. 6, thereby obviating the need for the lips 30 on the pockets 28. As another alternative, the caps 40 of FIG. 4 can be provided with means for snapping in place over the wings 18 in the manner of the lips 30 shown in FIG. 2, thereby obviating the need for the adhesive 42. As a further alternative, either of the shields 10 or 50 can be secured in place by a suitable adhesive to obviate possible tolerance problems with the specifically illustrated lips 30 and protrusions 68.

Another aspect of the invention that deserves mentioning is that advertising or various written information can be applied to the visible surfaces of the shield for any desired purpose.

It will be appreciated that the shield of this invention can be fabricated from materials in a variety of attractive and pleasing colors. However, it is preferred to utilize relatively light colors since very dark colored materials tend to absorb more heat from the sun than do light colored materials. In one especially preferred embodiment of this invention, the shield apparatus can either be made from or have a luminescent material applied to its outer surfaces. Such luminescent material will of course give off a soft light in dark environments to assist a user in locating a lock cylinder to insert a key therein.

Although preferred embodiments have been described in detail, it is to be understood that various changes, substitutions and alterations can be made therein without departing from the spirit and scope of the invention as defined in the appended claims.

What is claimed is:

1. In combination:

A metal lock mechanism of the type having a lock cylinder terminating in a coaxially aligned disc-shaped face plate with outwardly extending wings generally orthogonally disposed in relation to an outer surface of the face plate, the face plate having a keyway centrally located between the wings permitting insertion of a key therethrough into the lock cylinder; and a shield substantially covering the metal surfaces of the wings to permit manual operation of the lock mechanism by applying a rotational force thereto, whereby manual operative contact is limited to direct contact with the surfaces of the shield, the shield comprising a material having a relatively low thermal conductivity compared to that of the wings such that the fingers of an operator are protected from direct contact with metal;

wherein the shield comprises;

a base adapted to cover the outer surfaces of the face plate, the base including an opening for permitting insertion of a key into the keyway of the face plate, pockets adjoining the base and adapted to cover the wings, and means for securing the shield in place over the face plate and wings.

2. The combination of claim 1 wherein the base includes cylindrical walls for covering the periphery of the face plate, the cylindrical walls including slots for passage of the wings therethrough.

3. The combination of claim 1 wherein the securing means comprises lip-shaped extensions of the pockets for snapping into place around corners of the wings.

4. The combination of claim 1 wherein a flexible slit membrane is disposed in the opening in the base, the membrane elastically closing when the key is removed from the keyway thereby serving as a dust shield for the keyway.

5. The combination of claim 1 wherein the relatively low thermal conductivity material of the shield comprises a moldable elastomeric material, and the shield is integrally formed by molding.

6. The combination of claim 5 wherein the elastomeric material is selected from the group consisting of: polyisoprene, polybutadiene, and butadienestyrene copolymer.

7. The combination of claim 1 wherein the shield comprises: a pair of thermally insulating caps adhesively joined to the surfaces of the wings.

8. The combination of claim 1 wherein the shield is luminescent.

9. A shield for use with a metal lock mechanism of the type having a lock cylinder terminating in a coaxially aligned disc-shaped face plate, the face plate having a centrally located keyway for permitting the insertion of a key therethrough into the lock cylinder, wherein the shield comprises:

a base substantially covering the outer surfaces of the face plate, the base having walls defining a slotted opening in alignment with the keyway, the walls of the slotted opening being adapted to rotatably engage the edges of a key operatively inserted therethrough into the keyway, and handles integrally formed with the base and extending outwardly therefrom and juxtaposed on opposite sides of the slotted opening to permit manual rotation of the base by contact with the handles.

10. The shield of claim 9 further comprising protrusions integrally formed with the base and adapted to elastically snap in place about the peripheral edges of the face plate.

11. The shield of claim 9 which comprises a resilient plastic material.

12. The shield of claim 11 wherein the plastic is coated with a luminescent material.

* * * * *